United States Patent [19]

Taylor

[11] Patent Number: 4,771,940

[45] Date of Patent: Sep. 20, 1988

[54] REFUSE CONTAINER COVER

[76] Inventor: Craig V. Taylor, 8924 Enfield Ave., Northridge, Calif. 91325

[21] Appl. No.: 162,048

[22] Filed: Feb. 29, 1988

[51] Int. Cl.[4] ..... B65D 43/24

[52] U.S. Cl. ..... 220/335; 220/1 T

[58] Field of Search ..... 220/1 T, 334, 335

[56] References Cited

U.S. PATENT DOCUMENTS

| | | | |
|---|---|---|---|
| 4,151,928 | 5/1979 | Fagliano . | |
| 4,158,424 | 6/1979 | Carmack | 220/334 |
| 4,335,828 | 6/1982 | Robinson et al. | 220/334 |
| 4,342,402 | 8/1982 | Jungles | 220/1 T |
| 4,445,623 | 5/1984 | Kolling . | |
| 4,650,089 | 3/1987 | Sanders | 220/334 |

*Primary Examiner*—George T. Hall

*Attorney, Agent, or Firm*—Poms, Smith, Lande & Rose

[57] ABSTRACT

Enclosed herein is a container cover for use in conjunction with a refuse container characterized by a polymeric body formed into a substantially planar sheet. The sheet has a first side having a plurality of longitudinally extended ribs spanning the greater portion length of the sheet and a second side having a plurality of latitudinally transverse ribs spanning the greater portion of the width of the sheet. Support brace receiving bosses are provided to secure the cover in a fixed open position during refuse loading. The upper surface of the container cover is characterized by an arcuate span lengthwise and width wise, while the plane of the underside of the cover is characterized by a longitudinally arcuate span. In this manner, additional stiffness and durability is built into the refuse container cover.

16 Claims, 3 Drawing Sheets

FIG 1
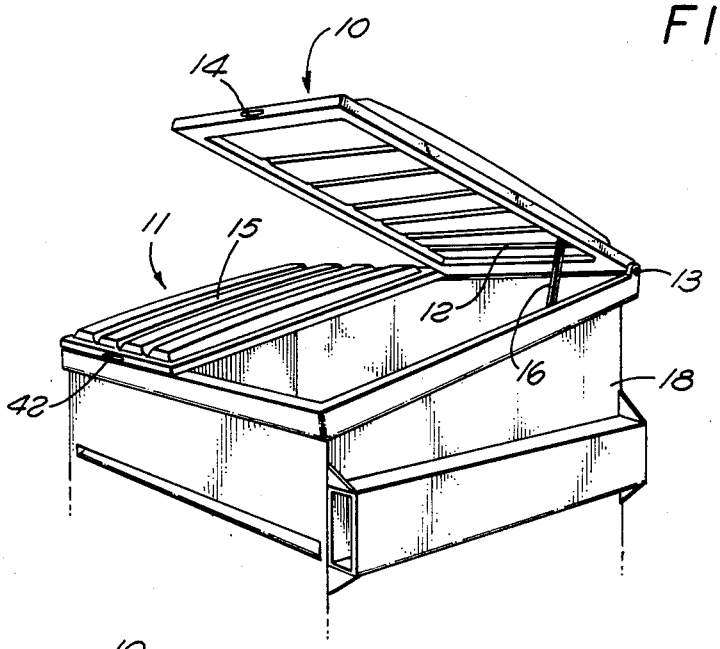
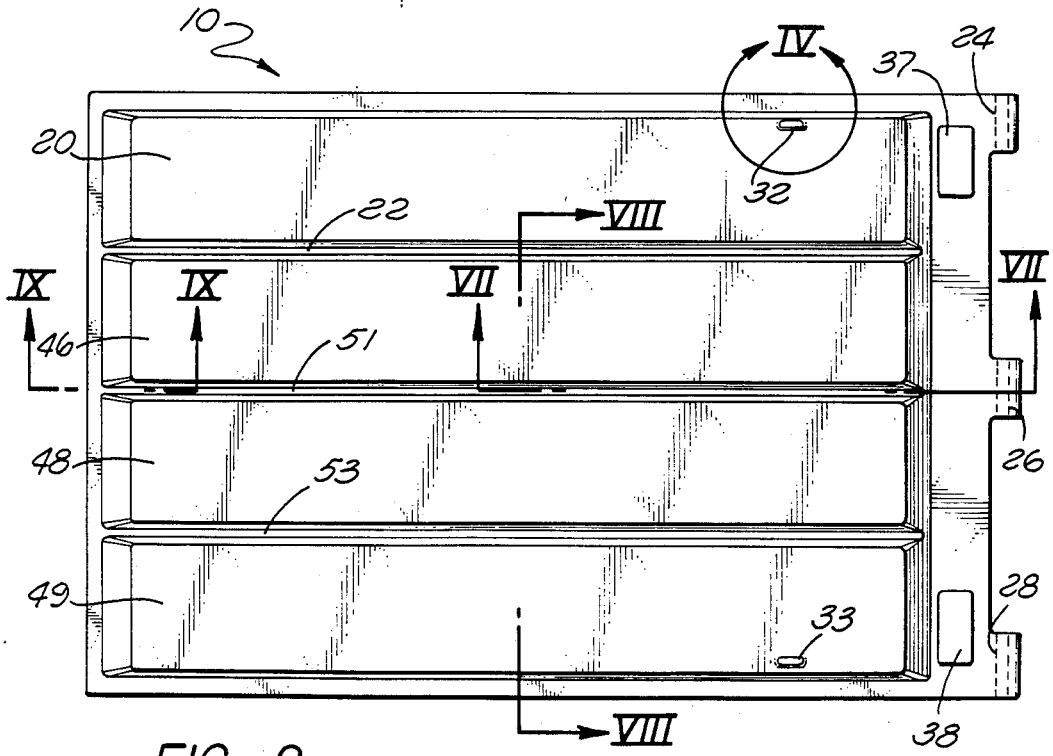
FIG 2

FIG. 3
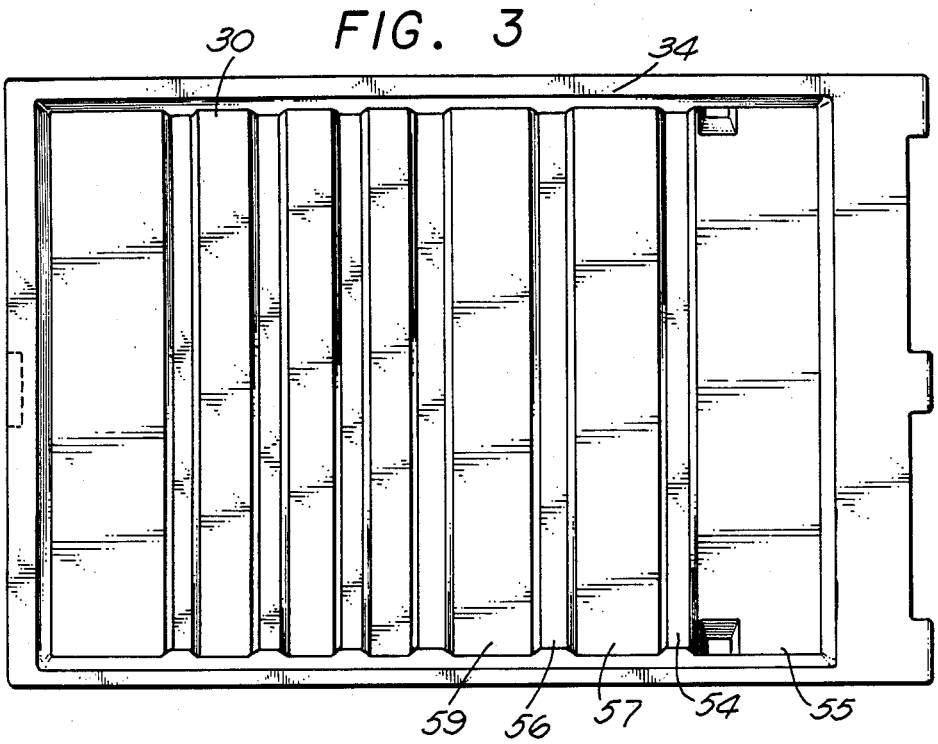
FIG. 5
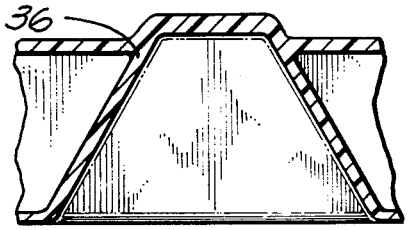
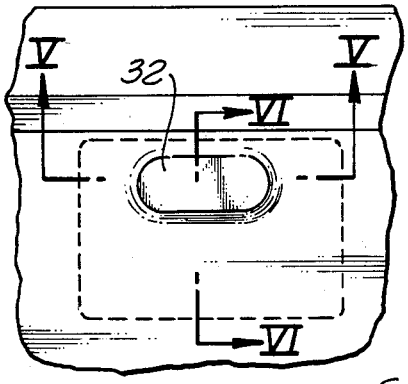
FIG. 4
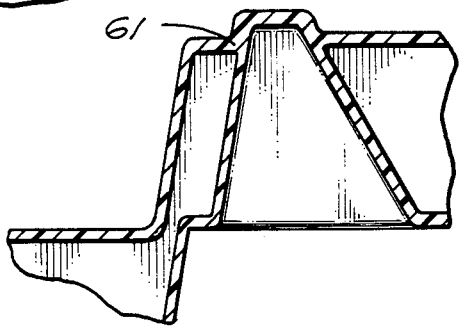
FIG. 6

REFUSE CONTAINER COVER

FIELD OF THE INVENTION

This invention relates to an improved container cover for use in conjunction with commercial refuse containers.

BACKGROUND OF THE INVENTION

Commercial refuse bins are usually large and of a rectangular shape for handling by mechanized refuse trucks. Heretofore, such large rectangular receptacles have been made from an open steel container with a flat metal or plastic lid in order to seal the contents. Such large containers typically have either rear or front loading and often provide hinged covers which can be raised to receive refuse, as well as automatically opening when the container is dumped by being lifted and overturned by refuse truck. The container lid or cover is an important component of these large rectangular refuse receptacles because they normally are required to hold refuse for at least several days or a week. For sanitary and other related reasons, it is necessary for the refuse container to be closed in order to minimize the escape of odors which would attract undesirable small animals. Since these refuse container must be lifted and turned over for dumping into a refuse truck, it is desirable that the refuse container be both strong and as light weight as possible. Covers have been made of steel but they have not proven satisfactory, as they are heavy, noisy, awkward to work with and become unsightly after a few months use.

As a replacement for steel or other metal covers, the prior art discloses refuse covers that are made as a one piece molded plastic cover. U.S. Pat. No. 4,158,424 to Carmack discloses a rubbish bin lid which has a flat surface and a projecting portion depending downward, a well as another portion projecting upward. The Jungles U.S. Pat. No. 4,342,402 is directed to a one piece planar molded plastic cover having embossed portions defining hinge structures along the rear edge and space transverse ribs across the width, and a longitudinal rib merged into the transverse ribs on one side of the cover. The Fagliano reference (U.S. Pat. No. 4,151,928) discloses a deformed and generally planar central section on the trash bin cover, which is made from polymer material. Also, U.S. Pat. No. 4,445,623 to Kolling et al. discloses a one piece plastic trash container having stiffening ribs along one side of the plastic trash container cover.

Although the preceding references attempt to provide a viable plastic cover, none of the prior art designs exhibit the strength and durability which approach these characteristics as exhibited by the heavier steel lids which they were intended to replace. It is further noted that the plastic lids of the prior art tend to sag and deform when subject to intense sun and high ambient temperatures. This of course defeats the purpose of the lids, which is to contain odors, and to block access to the containers by vermin and rodents. Further, when the prior art plastic lids were propped open they would often tend to bend down to a nearly closed position, so that the user would have to use one hand to raise the drooping lid while trying to deposit refuse.

Accordingly, a principal object of the invention is to provide a container cover for use in conjunction with commercial refuse containers, which is both lightweight and strong, having the durability of a heavy-weight metal cover, and which avoids the problems outlined hereinabove.

SUMMARY OF THE INVENTION

In accordance with a broad aspect of the invention, a plastic lid for commercial trash bins includes upper and lower sheet plastic surfaces which are grooved or ridged in opposite directions, so that the composite lid formed of the spaced apart upper and lower portions has increased strength and resistance to bending, both front-to-back and side-to-side.

In accordance with a feature of the invention the ridges on the top surface of the lid extend from front-to-back, to facilitate drainage.

The subject invention provides a refuse container cover which is both durable and flexible, having sufficient strength to contain any refuse which is in the bin, as well as resist twisting and crushing.

The container cover may be made from polymeric plastic material, such as cross-linked polyethylene, which has a molecular structure that locks together in all directions as a cross-link polymer compound to provide a netlike characteristic to the lid giving great strength, flexibility, in restorable "memory". If the container of the invention is bent, twisted or crushed, it can still return to its original shape time after time. By being made from two cross-ribbed layers of a flexible plastic, the container lid disclosed herein avoids many of the problems that a metal or prior plastic covers fail to overcome. The lid of this invention can withstand repeated bending or crushing which sometimes is an everyday occurrence in the trash hauling industry. In addition, the subject invention is highly resistant to stress cracking caused by various chemicals present in liquid and solid waste.

Additionally, a durable and flexible container lid is provided which resists high impact over a wide temperature range. Disclosed herein is a container cover for use in conjunction with a refuse container having a polymeric body formed into a double-walled substantially planar sheet bounded by a continuous peripheral edge. The sheet has a first side, having a plurality of longitudinally extending ribs spanning the length of the sheet. The sheet has a second side, having a plurality of latitudinally transverse ribs spanning the width of the sheet. Hinge means are provided integral to the sheet for pivotally securing the cover to the refuse container. In this manner, a lightweight, durable, flexible and resilient container cover is provided for pivotally securing at the top of an open container for opening and closing and otherwise providing access to the container. The planar sheet of the container includes a bracket receiving boss. This boss is provided to receive a support bracket which is pivotally secured at one end to the inner or outer side of the refuse container. The boss is positioned near the hinge means and the bracket. In this manner the cover may be fixed at an open angle to maintain the partially opened lid while refuse is being deposited, with the lid in the proper open orientation, and the container is at other times tightly closed.

One version of the hinge means includes a steel reinforcing tube integrally positioned along an edge of the sheet. The tube is positioned to receive a hinge rod, so that pivotal movement of the cover may be achieved.

When one version of the invention is disclosed, the longitudinally extending ribs which span the length of the sheet are positioned orthogonal to the transverse ribs spanning the width of the sheet. The longitudinally extending ribs are on the opposite sheet from the transverse ribs.

The container cover disclosed herein has a polymeric body which is rotationally molded to provide a substantially hollow planar sheet having longitudinally extending ribs on the first side and transverse extending ribs on the second side. In order to provide extra strength, the longitudinally extending ribs may have an arcuate span both along their length and from side to side. The transversely extending ribs on the under side of the cover may have an arcuate span side to side.

As a collateral feature, the covers may have a raised upper surface and a recessed inner surface so that a number of lids may be stacked and nested on top of other lids, for storage and shipping.

The increased stiffness of the lid in accordance with the invention, tightly seals the trash container against the escape of odors, and blocks access by vermin and rodents. Further, when the lid is propped open, there is no downward drooping of the lid, as in the case of prior plastic lids which have been employed, so that refuse may readily be deposited, without the need to raise the drooping lid.

These and other features and attendant advantages of the present invention will become apparent as the invention becomes better understood by reference to the following detailed description of the invention considered in conjunction with the accompanying drawings.

BRIEF DESCRIPTION OF THE DRAWINGS

FIG. 1 is a perspective view of a container cover illustrating the principles of this invention, used in conjunction with a refuse container.

FIG. 2 is a top plan view of the container cover 10 of FIG. 1.

FIG. 3 is a bottom plan view of the container cover of FIG. 1.

FIG. 4 is a enlarged view of the brace receiving boss of the container cover.

FIG. 5 is a cross-sectional view taken along line V—V of FIG. 4.

FIG. 6 is a cross-sectional view taken along line VI—VI of FIG. 4.

DETAILED DESCRIPTION OF THE PREFERRED EMBODIMENT

Figure 7:
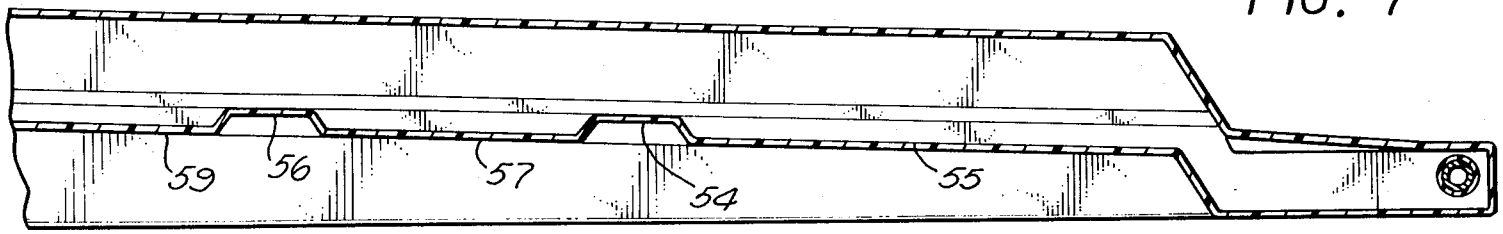
FIG. 7 is a cross-sectional view taken along line VII—VII of FIG. 2.

With reference to FIG. 1, container covers 10 and 11 are shown hinged to refuse container 18. Container cover 11 is shown closed, while container cover 10 is shown in a fixed open position raised by support brace 16. The cover is secured to the container through a hinge rod 13 which slides through an integrally positioned steel reinforcing tube which is rotary molded and integrally fitted into the lid 10. The lids may be opened and closed by inserting a user's hand into the handle slots 14 and 42 of covers 10 and 11 respectively. Longitudinal ribs such as 15 extend along the greater portion of the length of the top surface of the cover 11. Each cover also has a set of transverse ribs 12 which span side to side and protrude up and away from the container along the underside of the cover 10.

With reference to FIG. 2, the top plan view of the cover 10 shows parallel positioned longitudinally extending ribs 20, 46, 48 and 49. Between each pair of ribs are channels such as 22, 51 and 53. By deformedly extending outward, the upper longitudinal ribs provide a partial rigidity to the one piece plastic structure embodied by the cover 10. Along the rearward side of the top plan view of the lid 10 are three hinge flanges, each containing a steel reinforced tubing 24, 26 and 28. The steel reinforced tubing has been rotationally molded and made integral with the hinge flanges so as to maintain a one piece strong construction for the lid.

At either side of the lid, brace receiving bosses 32 and 33 are positioned to accept the support brace 16 in order that the lid be held in a fixed open position as shown in FIG. 1. Ownership or other information may be placed in the identification receiving regions 37 and 38 embossed on the rear side of the container cover.

With reference to FIG. 3, the underside of the container cover 10 is shown wherein corrugated transverse raised areas 30, 59, 57, and 55 and intermediate depressed ribs extend laterally across the cover 10. Dividing ribs 54 and 56 separate adjacent raised areas. The ribs extend inwardly from the surface of the cover and upward, as shown in FIG. 1.

With reference to FIGS. 4 through 6, it should be noted that the brace receiving boss 32 has reinforced support where double layers intersect as shown in FIGS. 5 and 6. In particular, surface boss interfaces such as 36 and 61 serve to strengthen that portion of the cover where the brace receiving boss is formed in order to handle the additional load when the support brace is placed in order to secure the cover in a fixed open position as shown in FIG. 1.

Figure 8:
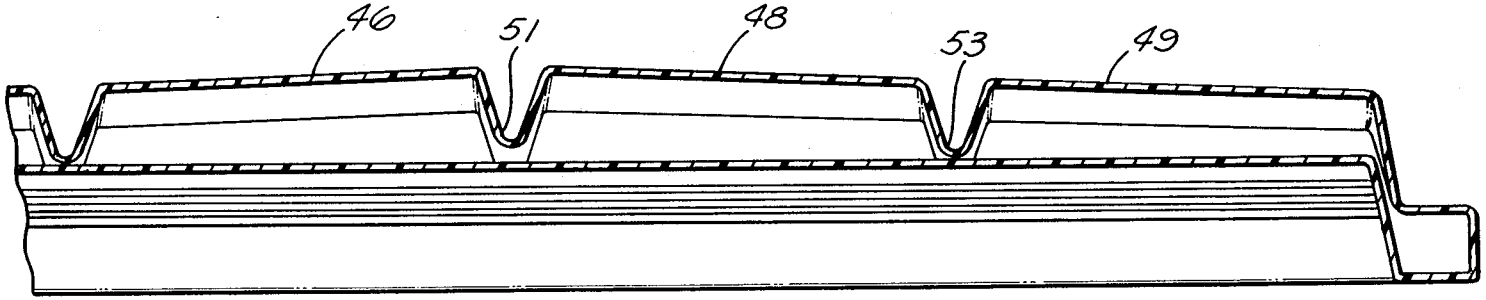
FIG. 8 is a cross-sectional view taken along line VIII—VIII of FIG. 2.

A longitudinal cross-sectional view of the cover 10 reveals an arcuate span extending along the length of the cover on both the upper and lower surfaces of the cover 10. Referring to FIG. 8, a similar arcuate span is shown extending from side to side on the upper surface of the cover 10. However, it will be noted that the lower surface runs parallel side to side and has no arcuate span. By providing a pre-stressed arcuate span, additional rigidity is imparted into the container cover of this invention. The lower surface and the transverse ribs therein could either be linear, from side to side, as shown in FIGS. 7 and 8 or could be slightly arched or arcuate in this direction.

Figure 9:
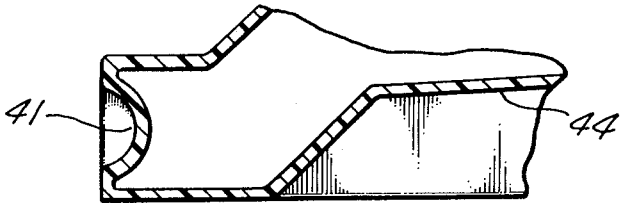
FIG. 9 is a cross-sectional view taken along line IX—IX of FIG. 2.

FIG. 9 shows a handle slot, such as 41 is formed by properly shaped longitudinally molded channel walls 44. In the preferred embodiment, the refuse container cover of this invention is manufactured from an organic polymer such as a polyethylene resin which is cross-linked and manufactured using conventional rotational molding techniques. An important aspect of this invention is the fact that the preferred embodiment uses a cross-linked polyethylene compound to manufacture the refuse container lids disclosed herein. Among the materials available include the polyethylene resin Sclair, a registered trademark of Dupont Canada of Mississauga, Ontario, Canada. Alternatively, cross-linked HDPE compounds of polyethylene resins may be used as manufactured by the Phillips Chemical Company of Bartlesville, Okla. under the registered trademark Marlex. Preferably, cross-linked polyethylene material is used to manufacture the cover of this invention. A variety of polyethylenes may be used with the principal requirement being that they be linear low-density polyethylites. The nature of the organic polymer is preferably such that it has thermal setting characteristics. However, included within the materials which may be used to manufacture the cover of this invention are thermo plastic materials such as vinyl, polyethylene, and polypropylene.

The refuse container lids are preferably formed by a rotational molding process. Rotational molding is known per se, and involves closing two metal mold halves and clamping these together. Heat is applied to the mold at a controlled temperature, while the mold is rotated simultaneously about two axes, with powdered plastic particles within the mold. The tumbling plastic particles melt and gradually fuse to form a homogeneous layer of substantially uniform thickness over the entire inner surface of the mold. A hollow article having a substantially continuous outer surface layer is thus formed. The refuse container lids could be formed by other techniques, such as by forming the upper and lower surfaces separately, and bonding them together along their peripheries by blow molding or any other hollow part molding process; however, the rotational molding, or roto-molding process is preferred.

It may also be noted that lids may have a raised upper surface, and a mating recessed lower surface so that the lids may be stacked in a nested or interfitting manner. To give the general idea of dimensions, for a commercial trash bin which is three feet deep and six feet wide, each of the two lids as shown in FIG. 1 may be approximately 40 inches from front to back and 37 inches from side to side. The wall thickness of the roto-molded product varies sightly, but is in the order of 3/32 inch to 3/16 inch, with the walls generally being about ⅛ inch thick.

While a particular preferred embodiment has been disclosed, it will be understood that variations and modifications may be effected without departing from the spirit and scope of the spirit and concept of this invention. Thus, by way of example and not of limitation, the ribs on the upper and lower plastic sheets forming the lid need not be perpendicular, from side-to-side, and from front-to-rear; instead any opposing configuration may be employed, for example, with the ribs on the upper surface being angled in one direction at 45 degrees, and the ribs on the lower sheet being angled in the other direction at 60 degrees. Further, the ribs may either protrude outwardly or be directed inwardly from the two surfaces of the cover. Accordingly, it is intended that the accompanying claims cover the alternative versions of the invention as shown as well as equivalent embodiments.

What is claimed is:

1. A container cover for use in conjunction with a refuse container, comprising:

a plastic body formed into a double wall substantially planar sheet bounded by a substantially continuous peripheral edge; said sheet defined by a first side having a plurality of longitudinally extending ribs spanning the greater part of the length of said sheet; and, a second side having a plurality of transverse ribs spanning the greater part of the width of the said sheet, with said first and second sides being spaced apart from one another; and integral hinge means for pivotally securing side cover to the refuse container;

whereby, a light-weight, durable, flexible and resilient container cover is pivotally securing to the top of a commercial trash container.

2. A container cover as in claim 1, wherein:

said planar sheet defines a bracket receiving reinforced recess; said reinforced recess being provided to receive a support bracket which is pivotally secured at one end to the side of said refuse container;

said reinforced recess positioned near said hinge means and said bracket;

whereby said cover may be fixed at an open angle to maintain a partially opened lid without significant bending or drooping even under high temperature conditions.

3. A container cover as in claim 1, wherein said hinge means comprises:

a steel reinforcing tube integrally positioned along an edge of said sheet;

said tube positioned to receive a hinge rod; whereby, pivotal movement of said cover is achieved.

4. The container cover as in claim 1, wherein:

said longitudinally extending ribs spanning the greater part of the length of said sheet are positioned orthogonal to said transverse ribs spanning the greater part of the width of said sheet.

5. The container cover as in claim 1, wherein:

the plastic body is molded to provide a substantially hollow planar assembly having longitudinally extending ribs on said first side and transverse extending ribs on said second side.

6. The container cover as in claim 1, wherein:

said longitudinally extending ribs have an arcuate span along their length and side to side; and, said latitudinally extending ribs have an arcuate span side to side.

7. The container cover of claim 1, wherein:

said cover is formed of cross-linked polyethylene.

8. A cover for commercial trash containers as defined in claim 1 wherein said cover has a raised upper portion and a recessed lower portion having dimensions which match but which are slightly larger than said raised upper portion, whereby a plurality of said lids will nest and stack when piled on top of one-another.

9. A plastic lid for commercial trash bins, comprising:

an upper first sheet surface and a lower second sheet surface;

said first and second sheet surfaces each having ridges formed in substantially opposite directions;

whereby, a composite lid formed by said first and second sheet surfaces has increased strength and resistance to bending, both front-to-back and side-to-side.

10. The plastic lid of claim 9, wherein:

front-to-back ridges are formed on the first sheet surface which are slightly arcuate and serve to facilitate drainage.

11. The plastic lid of claim 9, wherein:

the ridges formed in opposite directions are orthogonal to each other.

12. A cover for commercial trash containers as defined in claim 9 wherein said cover has a raised upper portion and a recessed lower portion having dimensions which match but which are slightly larger than said raised upper portion, whereby a plurality of said lids will nest and stack when piled on top of one-another.

13. A container cover as defined in claim 9, wherein said cover is a hollow rotationally molded product.

14. A container cover for commercial trash bins, comprising:

an upper first side having a plurality of longitudinally extending ribs spanning the greater portion of length of said cover, said upper first side being substantially convex;

a lower side having a plurality of latitudinally extending ribs spanning the width of said lid, said lower side being substantially concave; and, a molded reinforced hinge for receiving a rod for pivotally attaching said cover to a commercial trash bin.

15. A cover for commercial trash containers as defined in claim 14 wherein said cover has a raised upper portion and a recessed lower portion having dimensions which match but which are slightly larger than said raised upper portion, whereby a plurality of said lids will nest and stack when piled on top of one-another.

16. A container cover as defined in claim 14, wherein said cover is a hollow molded product.

* * * * *